US006947019B2

(12) United States Patent
Sato et al.

(10) Patent No.: US 6,947,019 B2
(45) Date of Patent: Sep. 20, 2005

(54) DISPLAY MODULE

(75) Inventors: Toshihiro Sato, Mobara (JP); Yoshiyuki Kaneko, Hachiouji (JP); Yoshiro Mikami, Hitachioota (JP); Takayuki Ouchi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 393 days.

(21) Appl. No.: 10/103,789

(22) Filed: Mar. 25, 2002

(65) Prior Publication Data

US 2002/0140645 A1 Oct. 3, 2002

(30) Foreign Application Priority Data

Mar. 28, 2001 (JP) ..... 2001-092830

(51) Int. Cl.[7] ..... G09G 3/32

(52) U.S. Cl. ..... 345/82; 345/83; 345/76; 345/77; 315/169.3

(58) Field of Search ..... 345/82–83, 76–77, 345/90; 315/169.1, 169.3, 169.4

(56) References Cited

U.S. PATENT DOCUMENTS 5,952,789 A * 9/1999 Stewart et al. ..... 315/169.4
6,307,681 B1 10/2001 Aoki et al.
6,424,326 B2 * 7/2002 Yamazaki et al. ..... 345/77
6,501,226 B2 * 12/2002 Lai et al. ..... 315/169.1

FOREIGN PATENT DOCUMENTS

JP 6-161385 6/1994
JP 11-337910 12/1999
JP 2000-352941 12/2000

* cited by examiner

*Primary Examiner*—Amr A. Awad
(74) *Attorney, Agent, or Firm*—Antonelli, Terry, Stout & Kraus, LLP

(57) ABSTRACT

This display module performs a high quality display by preventing the effect resulting from a residual charge of a data signal in the previous scanning remaining in a capacitor of a pixel circuit.

The display module is provided with the pixel circuit having an active element that selects a pixel by a horizontal scanning signal supplied from a scanning line GL every intersection unit of multiple scanning lines GLs arranged in a matrix within a display region AR on a substrate SUB, a data holding element that holds a data signal supplied from the data line by the turn-on of this active element, and an organic light emitting diode OLED that emits light by the current supplied from a current supply line CSL in accordance with the data signal held in the data holding element, and a reset circuit RST that recovers at least either a capacitor CPR or a data line DL of the pixel circuit to an initial condition is provided before data for the pixel that corresponds to the next scanning line is sent to the data line after the scanning of the scanning line before one is finished.

6 Claims, 9 Drawing Sheets

DISPLAY MODULE

FIELD OF THE INVENTION

The present invention relates to an active matrix type display module, and more particularly to a display module provided with a pixel composed of an emitting device, such as an electro luminescence element or an LED (light emitting diode) that emits light by applying electric current to an emitting layer, such as an organic semiconductor thin film and a pixel circuit that controls the light emission operation of this pixel.

BACKGROUND OF THE INVENTION

In recent years, with the advent of advanced information society, the demand of a personal computer, a car navigation system, a portable terminal unit, a telecommunications system or these combined products is increasing. A thin, lightweight, and low power consumption display device is suitable for a display means of these products and a liquid crystal display module or a display module that uses an electrooptic element, such as a self light emission type EL element or an LED is used.

The display module that uses the self light emission type electrooptic element of the latter is provided with features, such as good visibility, a wide viewing angle, and suitability for a motion image display with a fast response, and is assumed to be suitable for an image video display in particular.

A display that uses an organic EL element (also called an organic light emitting diode, and may also be hereinafter abbreviated to an OLED) of which the emitting layer has organic matter in recent years is greatly expected as an OLED display in cooperation with a rapid improvement of luminous efficiency and the progress of network technology that enables visual communication. The OLED display has the diode structure in which an organic light emitting layer is sandwiched between two electrodes.

In order to increase the power efficiency in the OLED display constituted using such OLED, as described later, an active matrix driving method in which a thin film transistor (hereinafter referred to as a TFT) is used as a switching element of a pixel is effective.

An art that drives an OLED display in the active matrix structure is described in Japanese Patent Application Laid-open No.HEI04-328791, Japanese Patent Application Laid-open No.HEI08-241048, or the U.S. Pat. No. 5,550,066, for example, and an art related to a driving voltage is disclosed in International Publication No. WO98/36407.

A typical pixel structure of the OLED display has a pixel driving circuit (also hereinafter referred to as a pixel circuit) including two TFTs (the first TFT is a switching transistor and the second TFT is a driver transistor) that are first and second active elements and a capacitor (storage capacitance, that is a data signal holding element), and this pixel circuit controls the emitting luminance of an OLED. A pixel is arranged in each intersection portion in which M data lines to which a data line (or an image signal) is supplied and N scanning lines (also hereinafter referred to as gate lines) to which a scanning signal is supplied are arranged in a matrix of N rows multiplied by M columns.

For the drive of a pixel, a scanning signal (gate signal) is sequentially supplied to N rows of gate lines and a switching transistor is set to the on state (turned on) Subsequently, the scanning in the vertical direction is finished once within a one-frame period Tf and a turn-on voltage is re-supplied to the first (first-line) gate line.

In this driving method, the time when the turn-on voltage is supplied to a gate line is less than Tf/N. Usually, about one sixtieth 60th second is used as the value of the one-frame period Tf. Besides, one frame is displayed in two fields, the one-field period is set to haft of the one-frame period.

While the turn-on voltage is being supplied to a certain gate line, all switching transistors connected to the data line are set to the on state, and a data voltage (image voltage) is supplied to M columns of data lines simultaneously or sequentially synchronizing with the on state. This is usually used by an active matrix liquid-crystal display.

A data voltage is stored (held) in a storage capacitance (capacitor) while a turn-on voltage (hereinafter, turn-on is also merely referred to as ON. Equally, turn-off is also merely referred to as OFF) is supplied to a gate line, and is kept in almost their value for a one-frame period (or one-field period). The voltage value of the storage capacitance specifies the gate voltage of a driver transistor.

Accordingly, the value of the current that flows into the driver transistor is controlled and light emission of an OLED is controlled. The response time until voltage is applied to the OLED and the light emission starts is usually less than 1 $\mu$s, and even an image (motion image) of a quick movement can be followed up. A current supply line is provided to supply the current to the driver transistor and display current is supplied from the current supply line in accordance with a data signal held in the storage capacitance.

Incidentally, in an active matrix driving method, because light emission is performed over a one-frame period, high efficiency is realized. The difference is clear in comparison with a passive matrix driving method in which diode electrodes of an OLED are directly coupled to a scanning line and a data line respectively and driven without providing any TFT.

In the passive matrix driving method, because the current flows into the OLED only while the scanning line is being selected. Accordingly, to obtain the same luminance as the light emission of a one-frame period from only the light emission of the short period, the emitting luminance multiplied by almost the number of lines is required in comparison with the active matrix driving. To attain the purpose, a driving voltage and a driving current must inevitably be increased. However, a power consumption loss, such as generation of heat, is increased and the power efficiency is decreased.

Thus, the active matrix driving method is assumed to be more superior to the passive matrix driving method from the standpoint of a reduction in power consumption.

SUMMARY OF THE INVENTION

In the passive matrix type display module, the scanning line and the data line intersected and arranged in a display region on a substrate are drawn out to the outside of the display region as they are and connected to a driving circuit. A terminal pad for connecting the driving circuit to an external circuit is provided. However, it is difficult that such terminal configuration is applied to an active matrix type display module as is.

In an active matrix driving method of an OLED, when the current is supplied to a capacitor for holding a display over a one-frame period, the one-handed electrode of the capacitor is connected to an output terminal of a switching transistor and the other-handed electrode is connected to a common potential line for the capacitor or a current supply line through which the current is supplied to the OLED.

FIG. 6 is a block diagram for typically describing a configuration example of a conventional display module that uses an OLED, and FIG. 7 is an explanatory drawing of the pixel configuration in FIG. 6. This display module (image display module) is constituted by arranging a data driving circuit DDR, a scanning driving circuit GDR, and a current supply circuit CSS around a display unit AR (inside enclosed by a dotted line in the drawing) formed on a substrate SUB composed of an insulating material, such as glass, in a matrix array of multiple data lines DLs and multiple gate lines, that is, scanning lines GLs.

The data driving circuit DDR has a complementary circuit consisting of N-channel and P-channel type TFTs or a shift register circuit, a level shifter circuit, and an analog switch circuit composed of a single channel type thin film transistor of only an N channel or a P channel. Besides, the current supply circuit CSS uses only a bus line, and can also be constituted so that the current will be supplied from an external power supply.

FIG. 6 shows a system by which a common potential line COML for a capacitor is provided in the display unit AR, and the other-handed electrode of the capacitor is connected to this common potential line COML. The common potential line COML is drawn out from a terminal COMT of a common potential supply bus line COMB to an external common potential source. Besides, a system of connecting a capacitor to a current supply line without providing the common potential line is already known.

As shown in FIG. 7, a pixel PX has a first thin film transistor TFT 1 that is a switching transistor arranged in the area enclosed by a data line DL and a gate line GL, a second thin film transistor TFT2 that is a driver transistor, a capacitor CPR, and an organic light emitting diode OLED.

The gate of the thin film transistor TFT1 is connected to the gate line GL and the drain is connected to the data line DL. The gate of the thin film transistor TFT2 is connected to the source of the thin film transistor TFT1 and the one-handed electrode (positive electrode) of a capacitor CPR is connected to this connection point.

FIG. 8 is a block diagram for further describing the configuration of the display module of FIG. 6 having the pixel configuration of FIG. 7. The drain of the thin film transistor TFT2 is connected to a current supply line CSL and the source is connected to a first electrode layer (anode here) AD of the organic light emitting diode OLED. The other-handed end (negative electrode) of the capacitor CPR is connected to the common supply line COML branched from the common potential supply bus line COMB.

The data line DL is driven by the data driving circuit DDR and the scanning line (gate line) GL is driven by the scanning driving circuit GDR. Further, the current supply line CSL is connected to the current supply circuit CSS of FIG. 8 via a current supply bus line CSLB or an external current source via a terminal.

In FIGS. 7 and 8, when a pixel PX is selected by the scanning line GL and the thin film transistor TFT1 is turned on, an image signal supplied from the data line DL is stored in the CPR. Further, when the thin film transistor TFT1 is turned on, the thin film transistor TFt2 is turned on, the current from the current supply line CSL flows into the OLED, and this current continues over almost a one-frame period. The current that flows on this occasion is specified according to a signal charge stored in the capacitor CPR.

The operation level of the capacitor CUR is specified according to the potential of the common potential line COML. Accordingly, the light emission of the pixel is controlled. The current that flows out from an organic light emitting diode OLED flows from a second electrode layer (cathode here) CD into a current drain line that is not shown.

Because this system needs to provide the common potential line COML through part of a pixel region, what is called an aperture ratio is decreased and the improvement of brightness as the whole display module will be suppressed.

FIG. 9 is the same block diagram for typically describing another configuration example of a conventional display module that uses an OLED. In this example, the basic placement of the thin film transistors TFT1, TFT2 and the capacitor CPR that constitute each pixel is the same placement as FIG. 8, but differs in that the other end of the capacitor CPR is connected to the current supply line CSL.

That is, when a pixel PX is selected by the scanning line GL and the thin film transistor TFT1 is turned on, an image signal supplied from the data line DL is stored in the capacitor CPR. If the thin film transistor TFT2 is turned on when the thin film transistor TFT1 is turned off, the current from the current supply line CSL flows into the OLED. This current continues over almost a one-frame period in the same manner as FIG. 8. The current that flows on this occasion is specified a signal charge stored in the capacitor CPR. The operation level of the capacitor CPR is specified according to the potential of the current supply line CSL. Accordingly, the light emission of a pixel is controlled.

In this type of the display module described in FIGS. 6 to 9, the source electrode of the thin film transistor TFT2 that becomes a first electrode layer AD of the organic light emitting diode OLED is formed using a conductive thin film, such as ITO (indium tin oxide), and the first electrode layer AD of each pixel PX is isolated individually.

Further, because the second electrode layer that constitutes an emitting device is positioned on the uppermost layer of the emitting device, it is directly exposed to air and may generate corrosion. Usually, because a second electrode capacitor layer is formed all over in a film shape of supply concerning all pixels, it needs to be connected electrically to the lower layer wiring (connective electrode for second electrode, that is, also called a current drain electrode) to perform external connection. Because the terminal for supplying the current to this second electrode layer CD is directly drawn out to a terminal unit (terminal pad) of a substrate in the extension of the second electrode layer, corrosion is easy to generate in the vicinity of the terminal unit due to exposure to air.

FIG. 10 is a sectional view for describing the structure in the vicinity of a pixel of a display module that uses an organic light emitting diode. This display module is constituted by piling up a polycrystalline silicon semiconductor layer PSI that uses low temperature polycrystalline silicon as an ideal material, a first insulation layer IS1, a gate line (gate electrode) GL that is a scanning line, a second insulation layer IS2, a source electrode SD formed using an aluminum wire, a third insulation layer IS3, a passivation film PSV, a first electrode layer AD, an organic light emitting layer OLE, and a second electrode layer CD on a glass substrate SUB.

When a thin film transistor (this thin film transistor is a driver transistor) composed of the polycrystalline silicon semiconductor layer PSI, the gate line GL, and the source electrode SD is selected, an organic light emitting diode formed using the first electrode layer AD connected to the source electrode SD, the organic light emitting layer OLE, and the second electrode layer CD emits light and the light L is incident on the outside from the substrate SUB.

A scanning driving circuit in this type of display module sequentially supplies a scanning signal to multiple scanning lines and writes a data signal from a data driving circuit to a pixel circuit connected to the scanning line selected with this scanning signal. As described above, the pixel circuit is provided with two thin film transistors, a capacitor that is a data holding element, and an organic light emitting diode. The data signal from the data driving circuit is held in the capacitor that is the data holding element by the turn-on of the first thin film transistor that constitutes the pixel circuit as electrical charges that match the gray scale of the data signal.

Further, the current from a current supply line via a second thin film transistor that turns off by the turn-on of a first thin film transistor flows into an organic light emitting diode in accordance with the size that matches the gray scale of a data signal held in a capacitor and this diode is made to emit light.

After the scanning for the one row of a scanning line selected through a scanning driving circuit is completed, the scanning line of the next row is selected. The scanning in the vertical direction is performed sequentially by repeating this. When the last row is reached, the first scanning line (first row) is returned after the predetermined vertical blanking period and the operation is repeated again.

For a charge that corresponds to a data signal written to the capacitor of each pixel connected to the scanning line of the selected row, the charge is held until the row is scanned next. However, if the charge of the capacitor remains until the data signal is written next, the charge component of the previous data signal that remains in the capacitor affects electrical charges that correspond to a new data signal when the new data signal is written next. As a result, a gray scale becomes unstable and display quality is deteriorated.

Further, the charge of a data line according to the volume of the data line and a second electrode layer and the volume between the data line and a scanning line is also affected as well as the capacitor in a pixel.

To stabilize the write operation of such data signal, a buffer circuit of high driving performance can also be provided. However, a circuit scale is increased and the element area of a display module is increased. The buffer circuit that mounts a driving circuit in the periphery according to the predetermined substrate size widens a frame area and narrows an effective display region.

An object of the present invention is to provide a display module that prevents the effect of a data signal due to a residual charge before it remains in the capacitor of the pixel circuit (when the row was scanned previously) and enables a high quality display.

To attain the above object, the present invention provides a reset circuit that recovers at least either the capacitor of the pixel circuit or a data line in the data line that is an output line of a data driving circuit before the data for the pixel that corresponds to the next scanning line is sent after the scanning of the scanning line before one is finished.

This configuration prevents a data signal that is written anew from being affected by the previous data signal and enables acquisition of a high quality display module. Further, because the reset circuit is a simple switch, the space required on a substrate is extremely small and an effective display region will not be narrowed. A more specific configuration example of the present invention is described below. That is, (1) A display module has multiple scanning lines arranged in a matrix within a display region on a substrate and a pixel every intersection unit of multiple data lines that intersect the multiple scanning lines, and is provided with a current supply line that supplies display current to the pixel, wherein the pixel is provided with a pixel circuit having an active element selected by a scanning signal that is supplied from the scanning line, a data holding element that holds a data signal supplied from the data line by the turn-on of this active element, and an emitting device that emits light by the current supplied from the current supply line in accordance with the data signal held by the data holding element, the emitting device has a first electrode layer driven by the active element, an organic light emitting layer formed on the first electrode layer, and a second electrode layer formed on the organic light emitting layer, and a reset circuit that recovers the data holding element to an initial condition is provided before data is sent to the data line after the scanning of the scanning line before one is finished.

(2) In (1), the reset circuit recovers the data holding element and the data line are recovered to an initial condition.

(3) A display module circuit has multiple scanning lines arranged in a matrix within a display region on a substrate and a pixel every intersection unit of multiple data lines that intersect the multiple scanning lines, and is provided with a current supply line that supplies display current to the pixel, wherein the pixel is provided with a pixel circuit having an active element selected by a scanning signal that is supplied from the scanning line, a data holding element that holds a data signal supplied from the data line by the turn-on of this active element, and an emitting device that emits light by the current supplied from the current supply line in accordance with the data signal held by the data holding element, the emitting device has a first electrode layer driven by the active element, an organic light emitting layer formed on the first electrode layer, and a second electrode layer formed on the organic light emitting layer, and a reset circuit that recovers the data holding element to an initial condition is provided before data is sent to the data line after the scanning of the scanning line before one is finished.

(4) In (3), the reset circuit recovers the data holding element to an initial condition before data is sent to the data line after the scanning of the next scanning line is started.

(5) In any one of (1) to (4), the reset circuit performs recovery to the initial condition every scanning of the scanning line.

(6) In any one of (1) to (5), the reset circuit is provided in the rear stage of the data driving circuit and the front stage of the data line.

(7) In any one of (1) to (5), the reset circuit is provided at the termination position of the data line.

(8) In (1) to (5), the scanning driving circuit and the data driving circuit are arranged at the outside of the display region on the substrate and the adjacent two sides of the substrate respectively.

By using the above configuration of (1) to (8), a high quality display module is obtained preventing a data signal that is written anew from being affected by the previous signal data and a display module that will not narrow the area of an effective display region can be provided.

Besides, the present invention is not limited to the above configuration and the configuration of the embodiments described later, and, needless to say, enables various modifications without deviating from a technical idea of the present invention. Another purpose and configuration of the present invention will be evident from a description of the embodiments described later.

BRIEF DESCRIPTION OF THE DRAWINGS

Preferred embodiments of the present invention will be described in detail based on the followings, wherein.

DESCRIPTION OF PREFERRED EMBODIMENTS

Embodiments of the present invention are described in detail below with reference to the drawings of the embodiments.

An organic light emitting layer provided in each pixel that is not shown, but is described later performs a monochromatic or color display by emitting light in the luminance that is proportional to a current value and a color (including white) that depends on the organic materials and performs the color display that emits by combining a color filter, such as red, green, or blue with an organic layer that emits white light.

Figure 1:
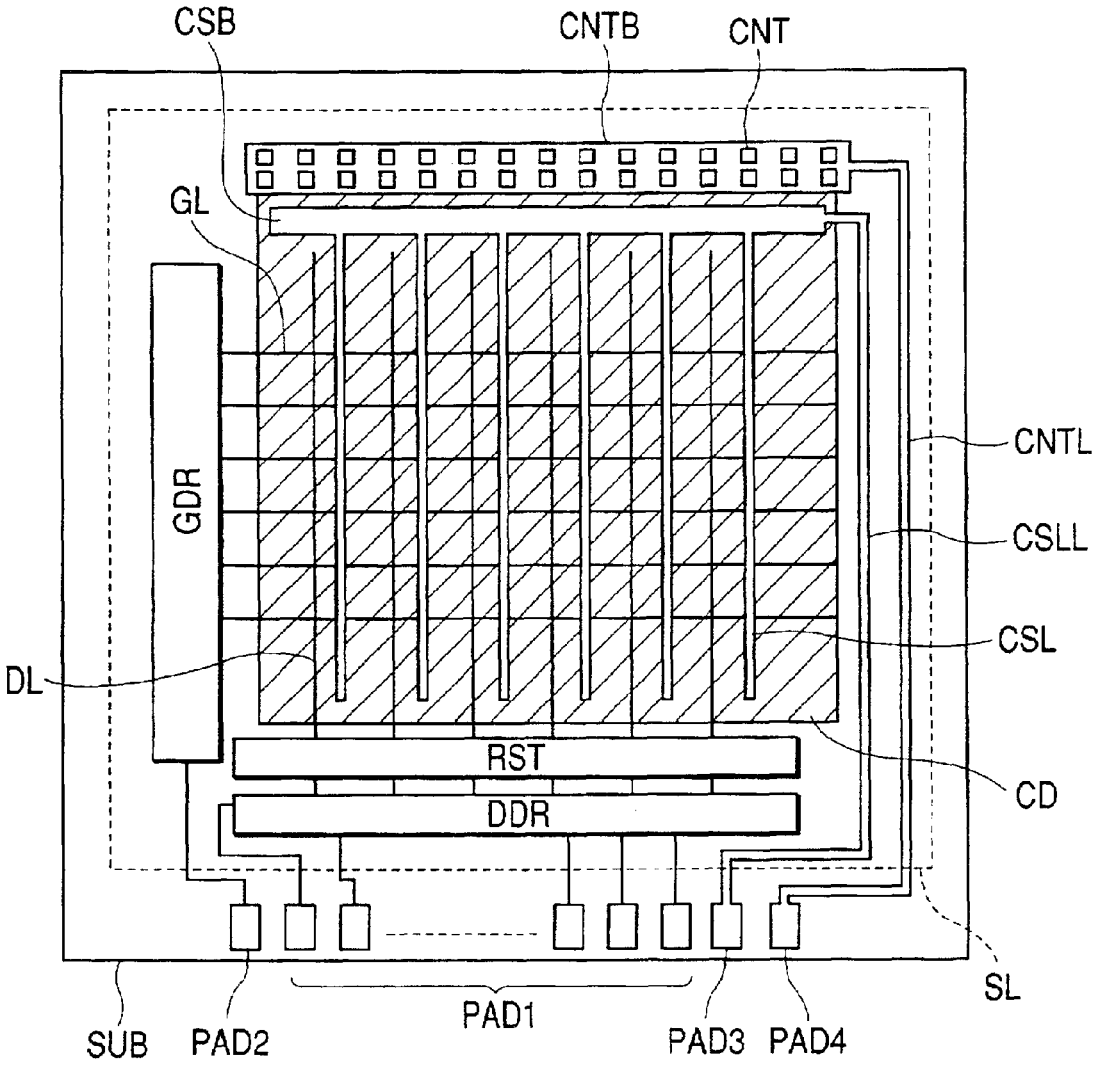
FIG. 1 is a block diagram for typically describing the configuration of a first embodiment of a display module according to the present invention.

FIG. 1 is a typical sectional view near a pixel for describing the configuration of a first example of a display module according to the present invention. The display module of this embodiment has a scanning driving circuit GDR and a data driving circuit DDR on a glass substrate SUB.

A pixel is formed in the area enclosed by a scanning line GL that is driven (scanned) by the scanning driving circuit GDR formed in a matrix, a data line GL driven by the data driving circuit DDR, and a current supply line CSL that is anode wiring. Further, terminal pads PAD1, PAD2 for supplying a signal and voltage to the scanning driving circuit GDR and the data driving circuit DDR from an external circuit are formed at one side of the substrate.

Subsequently, a reset circuit RST that recovers at least the data line or the capacitor of the pixel circuit to an initial condition is provided in the rear stage of the data driving circuit DDR and the front stage of the data line before the data sending to the next line is started after the scanning of the scanning line before one is finished in the unit scanning period (1-line scanning period) of the scanning line GL. First, the configuration of the pixel circuit of this embodiment and the operation are described.

Figure 2:
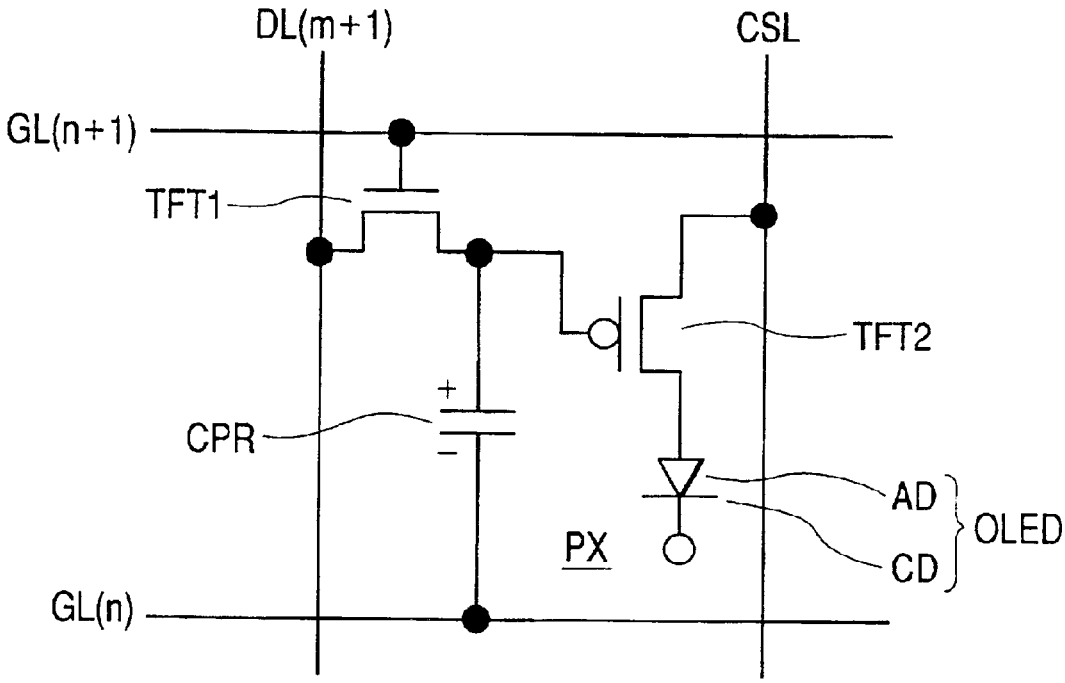
FIG. 2 is a block diagram of the pixel circuit of a pixel in FIG. 1.

FIG. 2 is a block diagram of the pixel circuit of a pixel in FIG. 1. The schematic configuration of this embodiment is as follows. That is, a pixel is formed in the area enclosed by a data line DL (m+1), scanning lines GL (n+1), GL (n), and a current supply line CSL. The scanning line that is being scanned (selected) currently is described here as GL (n+1).

Attention is paid to a pixel PX among multiple pixels selected by the scanning line GL (n+1). A first thin film transistor TFT1 that is an active element is a switching transistor and a second thin film transistor TFT2 is a driver transistor. The gate of the first thin film transistor TFT1 is connected to the scanning line GL (n+1). The drain is connected to the data line DL (m+1) and the source is connected to the gate of the second thin film transistor TFT2.

The drain of the second thin film transistor TFT2 is connected to the current supply line CSL to which the current is supplied from the current supply line bus line CSB shown in FIG. 1. Subsequently, the source is connected to a first electrode layer (anode here) AD of an OLED. One-handed terminal of a capacitor CPR as a data signal holding element is connected to the connection point between the source of the first thin film transistor TFT1 and the gate of the second thin film transistor TFT2 and the other terminal is connected to the preceding scanning line GL (n).

In the 1-pixel circuit configuration shown in FIG. 2, the one-handed terminal of the capacitor CPR connected to the connection point between the source of the first thin film transistor TFT1 and the gate of the second thin film transistor TFT2 is a positive electrode and the other-handed terminal connected to the scanning line GL (n) is a negative electrode.

Further, an organic light emitting diode OLED has the configuration in which an organic emitting layer (not shown) is sandwiched between a first electrode layer AD and a second electrode layer (cathode here) CD. The first electrode layer AD is connected to the source electrode of the second thin film transistor TFT2 and the second electrode layer CD is formed all over all pixels and connected to a connective electrode for second electrode CNTB of FIG. 1.

This connective electrode for second electrode CNTB is what is called a current drain line (electrode) and formed in the same layer as the terminal pads PAD1, PAD2 at the lower layer of a substrate. The electrode layer CD is connected through a contact hole CNT and connected to a terminal PAD4 formed in the same layer as the terminal pads PAD1, PAD2 through a connective line for second electrode CNTL.

Besides, the current supply line CSL that is the wiring of a first electrode layer is also connected to a terminal PAD3 formed in the same layer as the terminal pads PAD1, PAD2 through a current supply bus line CSB and current supply wiring CSLL. The connective electrode for second electrode CNTB in the outer side of the substrate and the inner side of a seal area of the substrate shown by a dotted line than the current supply bus line CSB is arranged.

The layout on the substrate in a system of being connected to an external circuit in one side through a flexible printed board is facilitated by arranging the connective electrode for second electrode CNTB that connects the second electrode layer CD through the contact hole CNT in the outer side of the substrate SUB and the inner side of the seal area SL than the current supply bus line.

The data signal written to the capacitor CPR by the turn-on of the first thin film transistor TFT1 and held as electrical charges flows into an organic light emitting diode OLED as a current amount controlled according to the electrical charges (indicate the gray scale of the data signal) in which the current from the current supply line CSL is held in the capacitor CPR by the turn-on of the second thin film transistor TFT2 that follows the turn-off of the first thin film transistor TFT2.

The organic light emitting diode OLED emits light at the luminance that is almost proportional to the supplied current amount and in a color that depends on an organic emitting layer material that constitutes the organic light emitting diode. In the case of a color display, usually, the organic emitting layer material is changed every pixel of red, green, and blue or a combination of a white organic emitting layer material and a color filter of each color is used.

Besides, a data signal ought to be assigned using either an analog quantity or a time-sharing digital quantity. Further, for gray scale control, an aerial controlled gray scale method by which the area of each pixel of red, blue, or blue is divided ought also to be combined.

Figure 3:
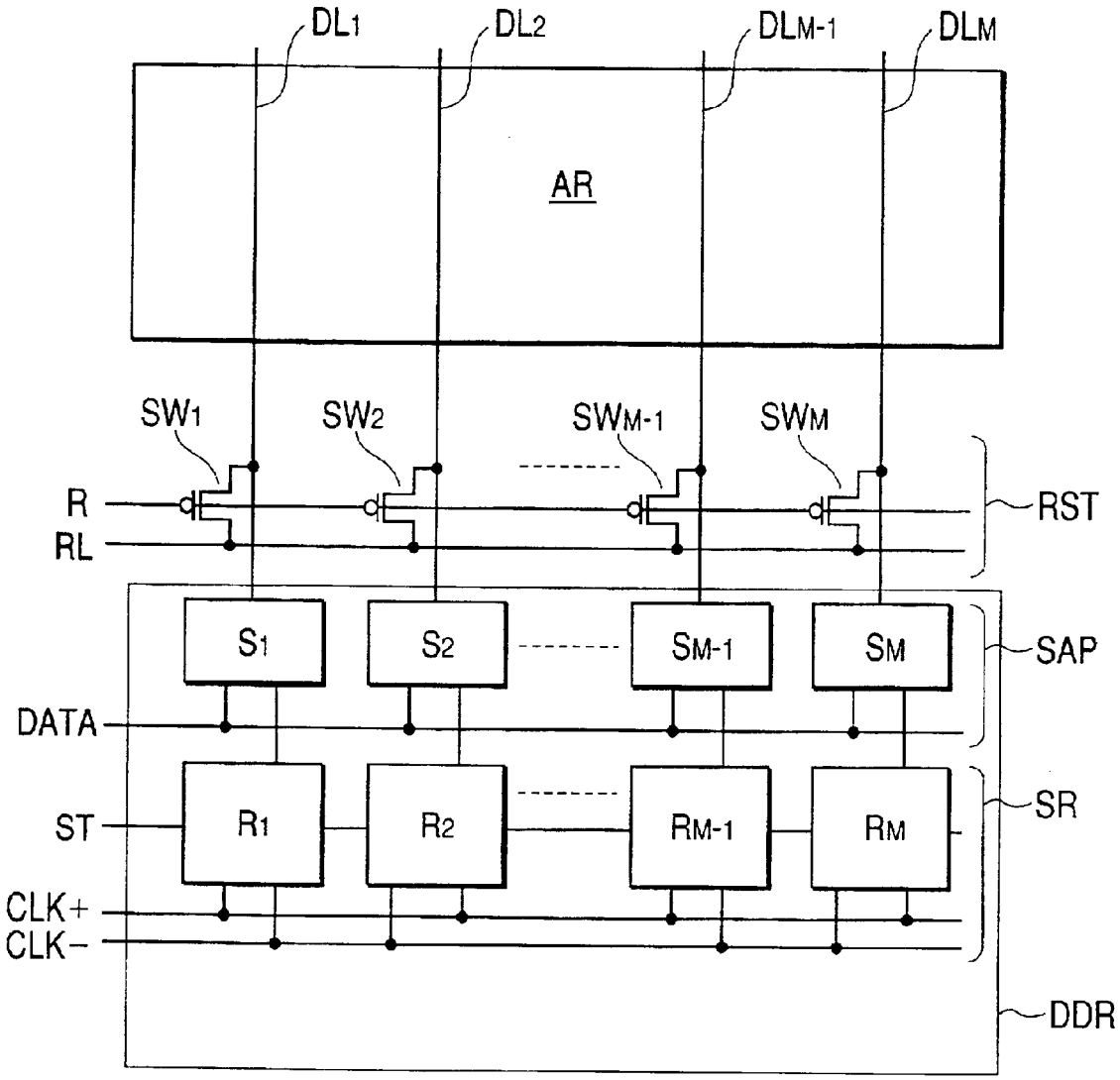
FIG. 3 is a block diagram for describing the principal part of the configuration of the first embodiment of the display module according to the present invention.

FIG. 3 is a block diagram for describing the principal part of the configuration of the first embodiment of the display module according to the present invention. Many pixels of the configuration described in FIG. 2 described above are arranged in a matrix shape in a display region AR. The part of a data driving circuit and only a data line are shown here.

Figure 4:
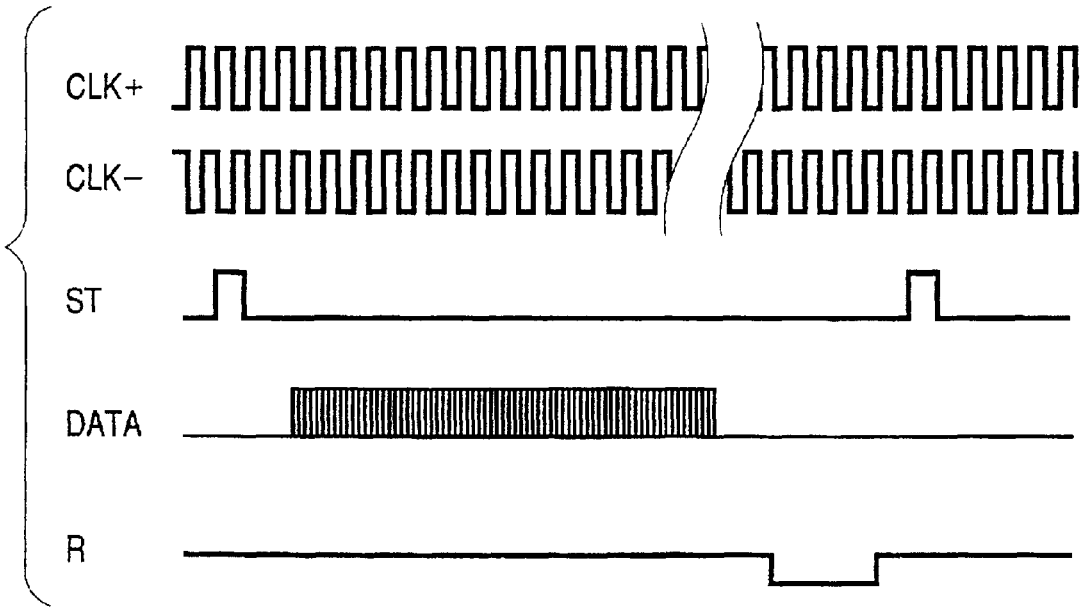
FIG. 4 is a timing chart for describing the operation of the embodiment of FIG. 3.

Further, FIG. 4 is a timing drawing for describing the operation of the embodiment of FIG. 3. Each signal shown using the same reference symbol In FIGS. 3 and 4 is identical. The configuration and operation of FIG. 3 are described below with reference to the timing chart of FIG. 3.

A data driving circuit DDR shows a shift register SR and a sampling circuit SAP and the detailed configuration is not illustrated. The data driving circuit is provided with the 1-system shift register SR that inputs a start pulse ST and pixel clock signals (hereinafter simply referred to as clocks) CLK+ and CLK− and sequentially transfers a data signal DATA to multiple data lines and the sampling circuit SAP that samples the data signal from the shift register SR and supplies it to a data line DL.

A reset circuit RST provided with a switching element SW for recovering each data line to the predetermined reset level (initial potential) RL immediately behind this sampling circuit and immediately in front of each data line DL respectively is provided.

The shift register SR has blocks (registers) $R_1$, $R_2$, . . . $R_{M-1}$, RM every data line and sequentially issues the output that synchronizes with the clocks CLK+CLK− to the sampling circuit SAP in accordance with the input of the start pulse ST.

The sampling circuit SAP has the sampling circuits SRs ($S_1$, $S_2$, . . . $S_{M-1}$, $S_M$) every data line DLs ($DL_1$, $DL_2$, . . . $DL_{M-1}$, $DL_M$) and performs switching operation and transfer operation that sample a data signal DATA by the output from the shift register SR ($R_1$, $R_2$, . . . $R_{M-1}$, $R_M$) and supplies it to the data lines. The reset circuit RST has switches $SW_1$, $SW_2$, . . . $SW_{M-1}$, $SW_M$ consisting of a p-type thin film transistor each.

When a data signal is supplied to these data lines, all the switches $SW_1$, $SW_2$, . . . $SW_{M-1}$, $SW_M$ of the reset circuit RST are in the off state because a high level signal is applied to the reset terminals. Accordingly, the data signal from the sampling circuits $S_1$, $S_2$, . . . $S_{M-1}$, $S_M$ is transferred to each of the data lines $DL_1$, $DL_2$, . . . $DL_{M-1}$, $DL_M$. The transferred data signal is written to each pixel and is held in the, capacitor as a charge.

After the write operation of the data signal to the pixel circuit for the one row (one line) described above is finished and the selection of the scanning line of the row is finished, a low level reset signal R is input to each of the switches $SW_1$, $SW_2$, . . . $SW_{M-1}$, $SW_M$ of the reset circuit RST and these switches are turned on.

Each of the data lines $DL_1$, $DL_2$, . . . $DL_{M-1}$, $DL_M$ is set to a reset level RL that is a reference voltage by the turn-on of each of the switches $SW_1$, $SW_2$, . . . $SW_{M-1}$, $SW_M$ of this reset circuit. This reset is completed before the data signal of the next line is issued and a data line and a capacitor are reset.

Accordingly, when the data signal is written next, an initial condition in which all data lines are written becomes fixed and a uniform image display is obtained that depends on the size of the data signal in the front stage and the size of the previous data signal of the row and will not generate dispersion in the holding charge of the capacitor corresponding to a data signal that is generated.

Besides, when the reset is finished before the scanning line of the next row is selected, only agate line is reset because a capacitor is not reset. Even in this case, writing that will not depend on the size of the data signal in the previous stage is enabled.

In this embodiment, a 1-system shift register is used, but the case where a multiple-system shift register is used instead of it can be applied in the same manner. Further, the case where the sampling circuit has the configuration that corresponds to multiple data signals can also be applied in the same manner.

Further, when the transistor that is a switching element that constitutes a reset circuit uses an n-type thin film transistor, a signal of which the polarity of the reset signal shown in FIG. 4 is reversed ought to be used. Further, this switching transistor can also use a transfer gate in which n-type and p-type transistors are combined.

In this embodiment, a high quality display module is obtained preventing a data signal that is written anew to a capacitor of a pixel circuit from being affected by the previous data signal.

Figure 5:
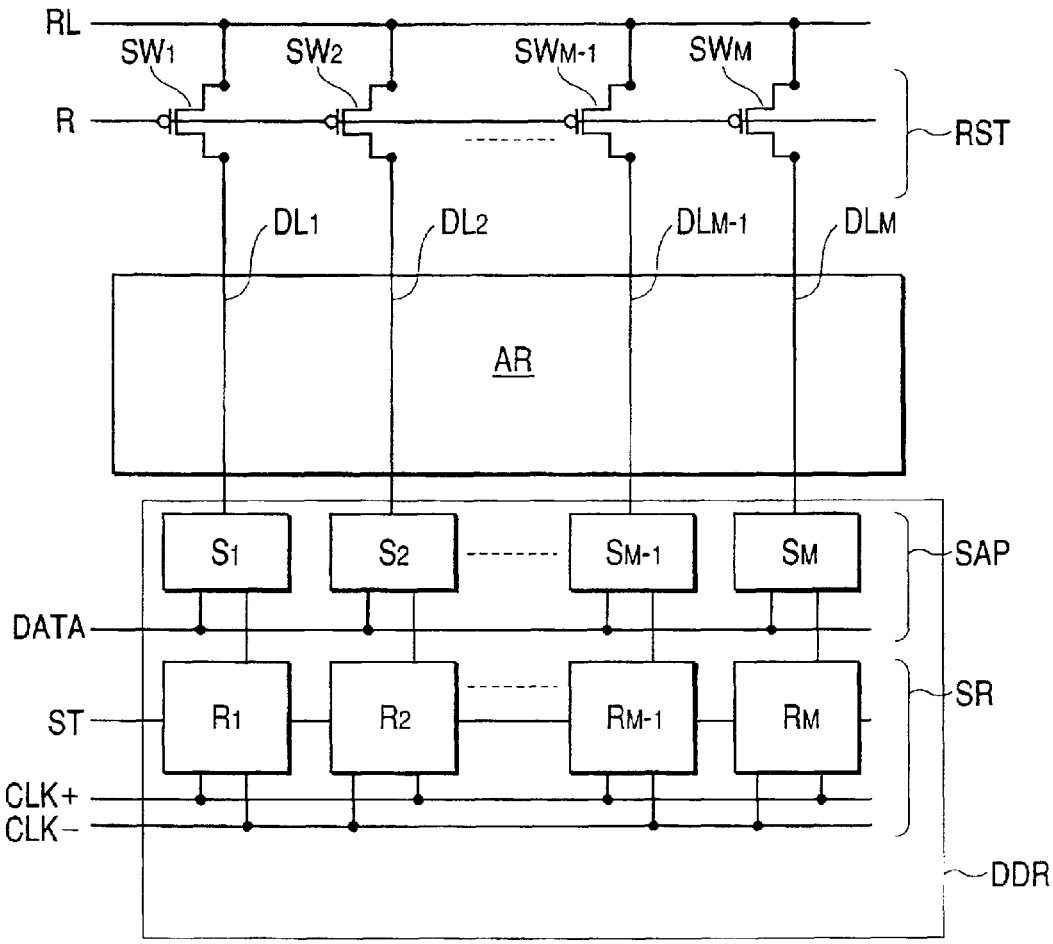
FIG. 5 is a block diagram for describing the principal part of the configuration of a second embodiment of the display module according to the present invention.
Figure 6:
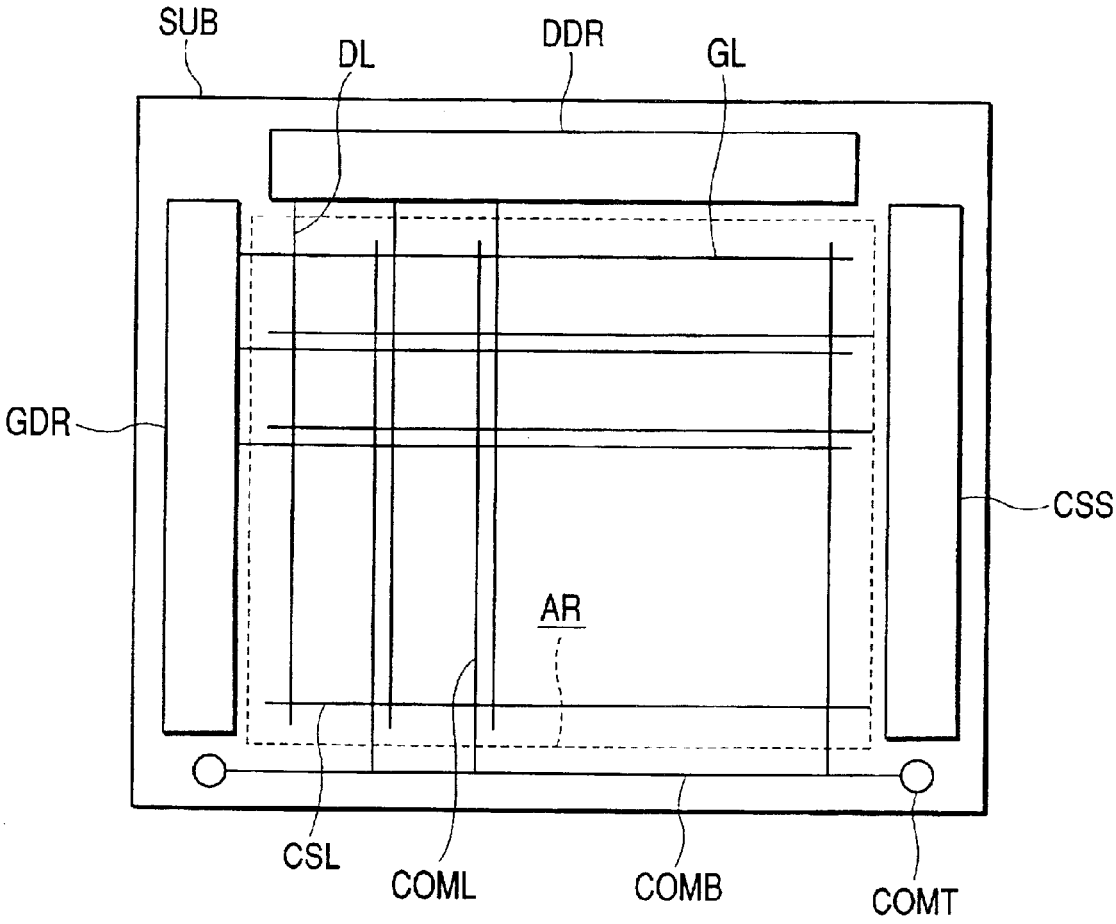
FIG. 6 is a block diagram for typically a configuration example of a conventional display module that uses an organic light emitting diode.
Figure 7:
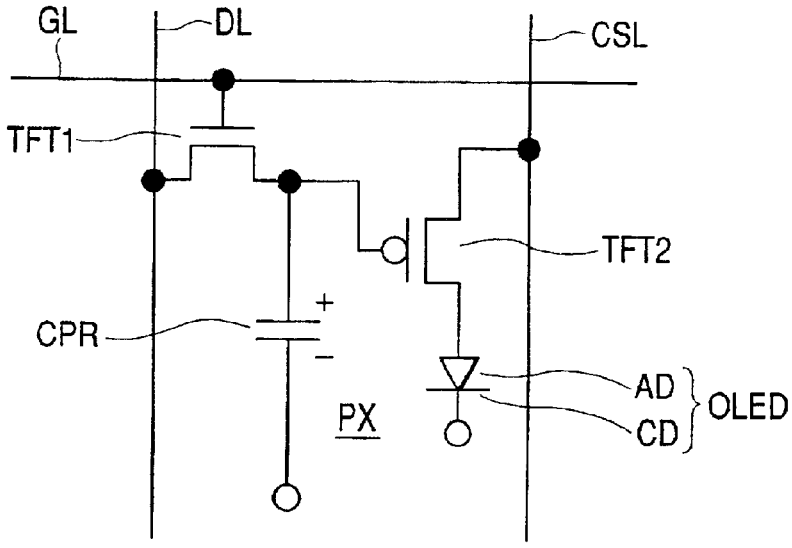
FIG. 7 is an explanatory drawing of the pixel configuration in FIG. 6.
Figure 8:
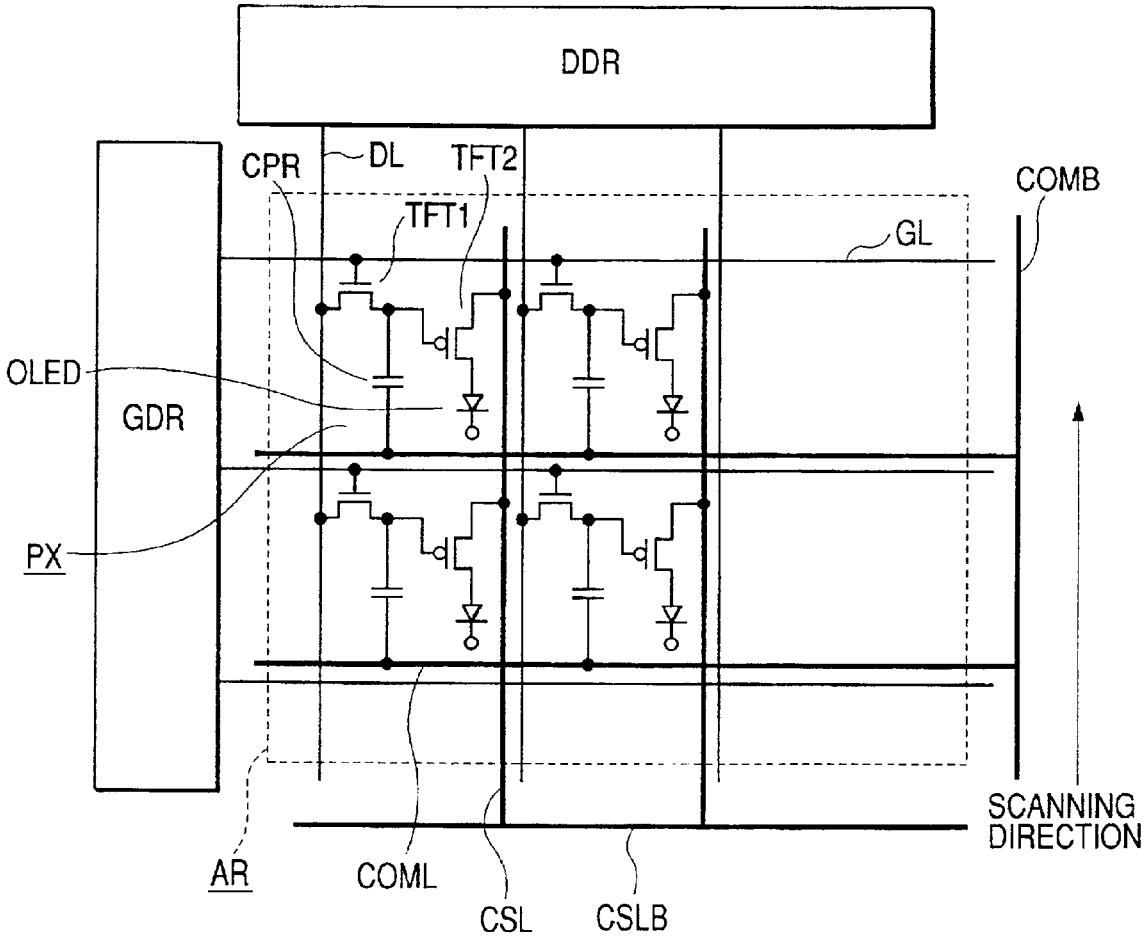
FIG. 8 is a block diagram for further describing the configuration of the display module of FIG. 6 having the pixel configuration of FIG. 7.
Figure 9:
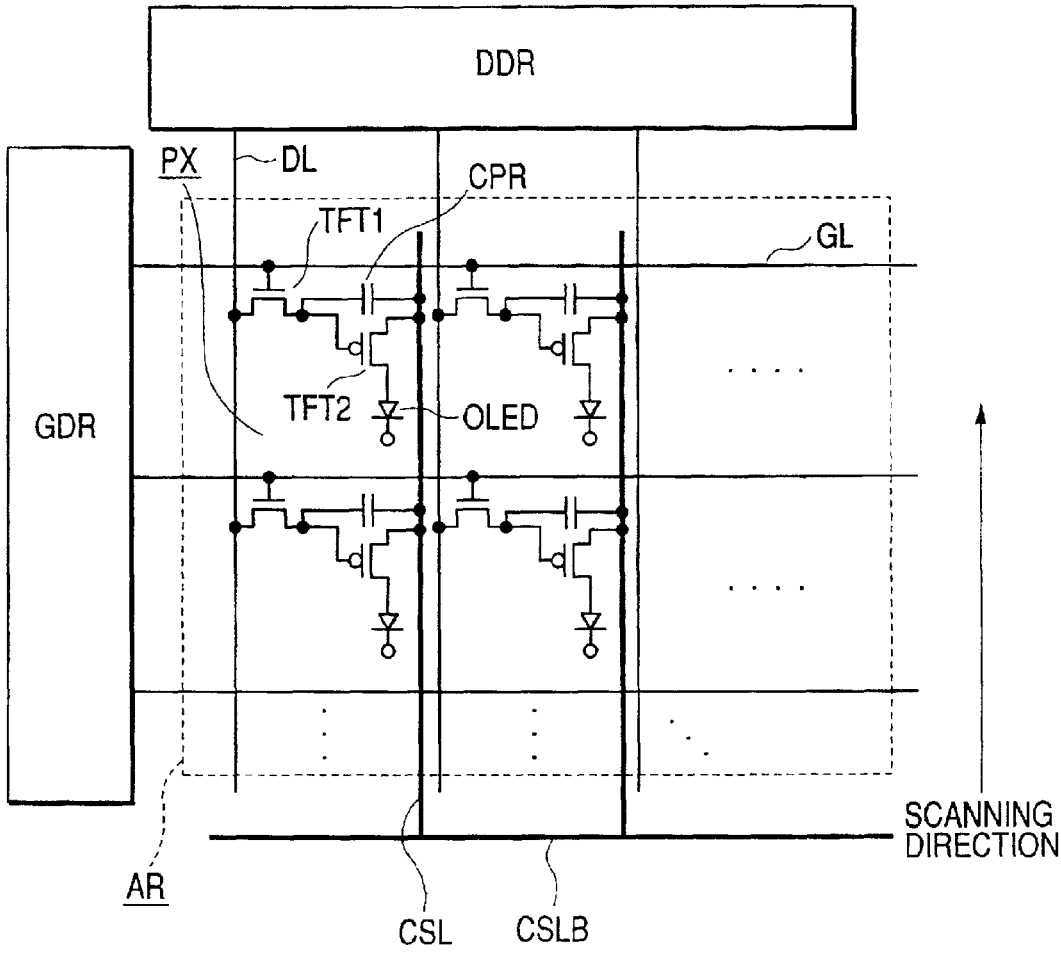
FIG. 9 is the same block diagram of FIG. 8 for typically describing another configuration example of the conventional display module that uses the organic light emitting diode.
Figure 10:
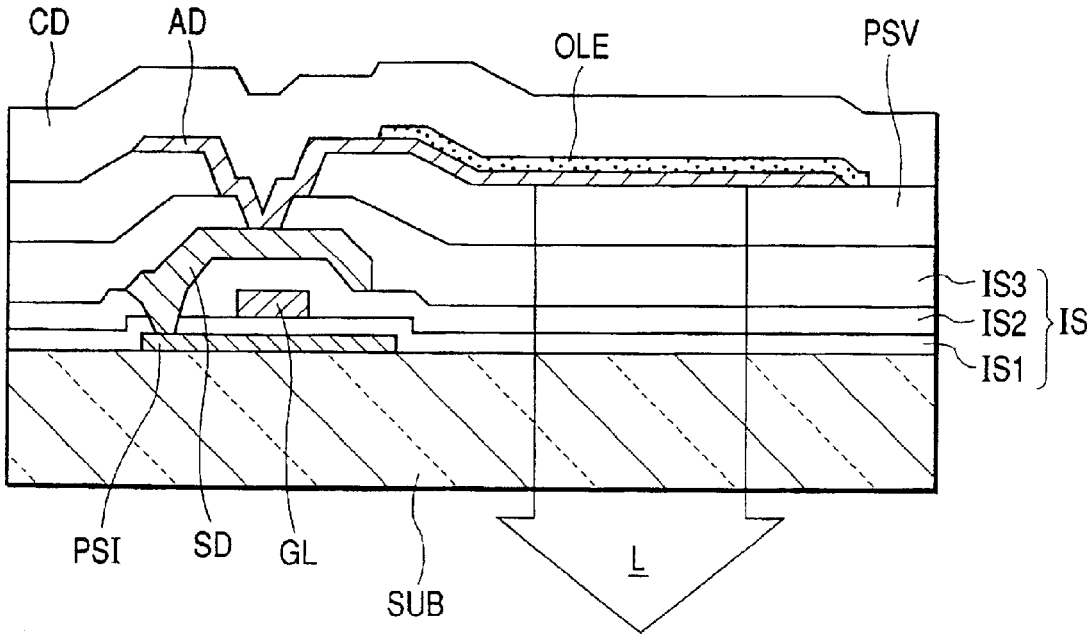
FIG. 10 is a sectional drawing for describing the structure near the display module that uses the organic light emitting diode.

FIG. 5 is a block diagram for describing the principal part of the configuration of the second embodiment of the display module according to the present invention. Many pixels of the configuration described in FIG. 2 are arranged in a matrix shape in a display region AR in the same manner as FIG. 3. Further, FIG. 5 also shows the part of a data driving circuit and only a data line.

This embodiment differs from the first embodiment in that a reset circuit RST is arranged at the opposite side (termination position of a data line DL) with a display region AR sandwiched for a data driving circuit DDR. The circuit configuration of the shift register SR, the sampling circuit SAP, and the reset circuit RST and the timing are identical with those of the first embodiment.

In this embodiment, the effect of noises resulting from various wiring layouts on a substrate can be reduced because a reset circuit RST is provided at a distant position from a data driving circuit DDR. Further, when a reset circuit is arranged within the fixed substrate size, the layout is simplified.

Besides, the present invention is not limited to a display module that uses the above OLED, but can also be applied to another display module that performs a display in the same light emission operation as the OLED.

Further, the above embodiment is described using an anode in a first electrode layer and a cathode in a second electrode layer. However, the embodiment can also be applied to the configuration reverse to the above, that is, the case where the cathode is used in the first electrode layer and the anode is used in the second electrode layer in the same manner. Further, the embodiment can be applied to the case where a pixel circuit uses a 2-transistor system as well as the case where it uses a 4-transistor system.

As described above, according to the present invention, a high quality display module is obtained preventing a data signal written anew from being affected by the previous data signal. Further, because the reset circuit is a simple switch, a display module of which the space required on a substrate is extremely small and that will not narrow an effective display region can be provided.

What is claimed is:

1. A display module, comprising:

a substrate;

a plurality of scanning line, a plurality of data lines intersecting the plurality of scanning lines, and a current supply line, provided on the substrate respectively; and a plurality of pixels, provided in a display region on the substrate, each of the plurality of pixels having a first active element activated in accordance with a scanning signal supplied from one of the plurality of scanning lines to acquire a data signal supplied from one of the plurality of data lines, a data holding element for holding the data signal acquired by the first active element, a light emitting device, and a second active element activated in accordance with the data signal held by the data holding element to supply a current from the current supply line to enable the light emitting device to emit light, wherein the light emitting device includes a first electrode layer coupled to receive the current from the second active element, an organic light emitting layer formed on the first electrode layer, and a second electrode layer formed on the organic light emitting layer, and wherein a reset circuit is provided in the display module, to recover each of the plurality of data lines to an initial condition thereof before the data signal is supplied therethrough, whenever the acquisition of the data signal from the each of the plurality of data lines by the first active element in response to the scanning signal supplied to respective one of the plurality of scanning lines is completed.

2. The display module according to claim 1, wherein the reset circuit recovers the data holding element holding the data signal acquired by the first active element from the one of the data lines in response to the scanning signal supplied to the one of the scanning lines to an initial condition thereof in a period after the scanning signal is started to be supplied to the one of the scanning lines and before the data signal is supplied to the one of the data lines.

3. The display module according to claim 1, wherein the reset circuit recovers each of the plurality of data lines to the initial condition thereof, whenever the scanning signal is supplied to the respective one of the plurality of scanning lines.

4. The display module according to claim 1, wherein:

a data driving circuit is provided on the substrate, to output the data signal to the each of the plurality of data lines, and the reset circuit is disposed in a rear stage of the data driving circuit and a front stage of the plurality of data lines.

5. The display module according to claim 1, wherein:

a data driving circuit is provided on the substrate, and is connected to one end of each of the plurality of data lines, to output the data signal to each of the plurality of data lines, and the reset circuit is disposed at another end of each of the plurality of data lines.

6. The display module according to claim 1, wherein:

a scan driving circuit and a data driving circuit are provided outside of the display region on the substrate, the scan driving circuit being connected to the plurality of scanning lines and the data driving circuit being connected to the plurality of data lines, and one side of the substrate at which the scan driving circuit is arranged, is adjacent to another side thereof at which the data driving circuit is arranged.

* * * * *